United States Patent [19]

Stark et al.

[11] 3,997,711

[45] Dec. 14, 1976

[54] REDUCTION FURNACE CONTROL

[75] Inventors: Heinz Stark, Essen; Heribert König, Duisburg, both of Germany

[73] Assignee: Demag Aktiengesellschaft, Duisburg, Germany

[22] Filed: July 28, 1975

[21] Appl. No.: 599,811

[30] Foreign Application Priority Data

Aug. 2, 1974 Germany ..... 2437245

[52] U.S. Cl. ..... 13/9 R; 75/11; 266/156

[51] Int. Cl.[2] ..... F27D 7/00

[58] Field of Search ..... 13/1, 9, 31, 34; 266/15–19, 156

[56] References Cited

UNITED STATES PATENTS

| | | | |
|---|---|---|---|
| 2,894,831 | 7/1959 | Old et al. | 75/9 |
| 3,423,080 | 1/1969 | Keyser | 13/9 X |

*Primary Examiner*—R. N. Envall, Jr.
*Attorney, Agent, or Firm*—Mandeville and Schweitzer

[57] ABSTRACT

The invention covers methods and apparatus for controlled flue gas combustion during operation of a closed electric arc reduction furnace to produce metals and metal alloys while feeding a burden to the furnace chamber. The furnace chamber is closed by means of a flue gas hood of reduced height, complete with electrode conduits, gas exhaust pipes and charge devices. The flue gas hood is provided with one or more controlled recycled combustion gas and air supplies, through which combustion air and recycled gas enters the furnace chamber at spaced points thereover for maintaining a reduced temperature level adjacent the hood ceiling surface. The quantities introduced depend upon the prevailing temperature and/or gas analysis of the flue gas in the furnace chamber.

15 Claims, 5 Drawing Figures

REDUCTION FURNACE CONTROL

BACKGROUND OF THE INVENTION

Until now, hot reduction processes usually have been conducted by means of electric light arc furnaces of either open or semi-closed construction. These require an extensive exhaust gas purification system, as the non-utilized air quantity taken in by such furnaces constitutes an uncontrollable multiple of the gas produced in the furnace. A sufficiently large exhaust gas purification plant not only increases considerably the cost of the entire plant, but also requires a large area for its construction. In addition, it is difficult to adapt such filtering and purification systems to existing facilities without great expense and/or considerable delay in operation.

In order to decrease the quantity of non-utilized air, and thus be able to utilize smaller purifying plants, it has been suggested to perform the reduction process in closed electric reduction furnaces. Here, the combustion air enters the combustion chamber via a very broad slot, or via several intake openings distributed over the flue gas hood circumference. The combustion air quantity can be adjusted by opening or closing the intake openings. The slide valves or dampers required to alter the openings are controlled depending upon the prevailing temperature and/or flue gas analysis. Nevertheless, it is difficult to sufficiently close an electric reduction furnace with hot and turbulent operation to keep the exhaust gas purification facilities at an economically justifiable size due to the great exhaust gas quantity caused by the amount of non-utilized air entering the intake openings. Therefore, the familiar reduction methods require extremely expensive installations, both in construction and in operation.

In hot reduction processes, there are sometimes extremely hot gas eruptions with temperatures exceeding 2,000° C which penetrate the burden surface, resulting from the formation of sintered bridges on the burden surface. These gas eruptions require that a great distance exist between the flue gas hood ceiling and the burden surface, so that the metallic parts of the ceiling are not touched by the hot gases, but only after they mix with cooler gas. In order to keep the flue gas hood height within justifiable limits, the flue gas hood construction and the conduit elements of electrodes and charge devices must be made of expensive high temperature resistant materials. In addition, water cooling has to be provided, again increasing the cost of the plant.

STATEMENT OF THE INVENTION

This invention improves upon the reduction furnace operation in such a manner that a controlled reduction gas combustion and flue gas development, and thus a more exact dimensioning of the flue gas disposal plant, is feasible. Simultaneously, the flue gas hood ceiling is protected from the combustion heat of the flue gas. Controlled combustion air is directed via jets into a lower zone of the gas chamber immediately above the burden surface, and into an upper zone of the gas chamber, located directly beneath the flue gas hood ceiling, a cool inert or low oxygen gas is introduced in such a way that a strong flat stream is produced which sweeps along the flue gas hood ceiling.

With such an operation, the closed light arc furnace uses only very little surplus of combustion air. This surplus can also be decreased considerably because the combustion air can be injected in controlled amounts into the center of the lower gas chamber zone, while combustion air taken in by suction, as previously done, usually does not reach the center so that a great air surplus was needed to ensure complete combustion, particularly in the central regions of the furnace. Consequently, with the invention here, the flue gas purifying plant can be decreased substantially in size. Also, the distance of the flue gas hood ceiling from the burden surface can be kept shorter than before, due to the controlled and directed intensive cooling. This leads to a lower and lighter flue gas hood, its flat construction resulting in an important shortening of the electrode strands, and residual electrode strands. Further advantages of the invention are that the electrode mountings, their contacts, and the conduit cylinders can be serviced from the hood ceiling. The flat construction decreases the length of current supply lines, so that the alternate current energy transfer is more effective. Finally, the strong cooling gas current prevents dust accumulation at the flue gas hood ceiling. This eliminates the necessity of cleaning the flue gas hood, which was previously required at short intervals, particularly when charging a burden containing silicon. One of the important aspects of the invention is the utilization of recycled purified exhaust gas as cooling gas, which is low in oxygen due to the small surplus of combustion air.

The apparatus of the invention includes provision in the lower part of the flue gas hood shell, and around its circumference, with jets for combustion air introduction, and adjacent the upper part additional jets are connected to one or several lines of recycled purified exhaust gas. The combustion air and recycled gas lines incorporate one or several blowers. The combustion air jets are preferably connected to one or several annular lines. The rate of operation of the combustion air blower is controlled depending upon the furnace capacity as well as the exhaust gas analysis and/or temperature. Preferably, a flow meter is installed in each supply line between the individual jets and their supply.

The jets adjacent the flue gas hood ceiling are preferably arranged in concentric circles whereby the nozzles, preferably wide-angled jets, are arranged to project an air stream parallel or nearly parallel with the flue gas hood ceiling over the entire extent in a circular pattern so that a flat cooling current is produced which flows along the flue gas hood ceiling at high flow rates toward one or several gas exhaust flues in about the width of the ceiling radius. This results in an intensive cooling of the hood ceiling. This, in turn, eliminates the need for a high hood ceiling to protect it from the intense heat of combustion. A further feature of the invention includes a cooling air jet disposed in the free central area of the flue gas hood with the jet having a radial annular nozzle, or alternatively, with several lateral nozzles. This ensures that this area of the hood ceiling is also cooled thoroughly. Alternatively, this central area of the flue gas hood ceiling is provided with a burden charge pipe. The latter may be encased by a spaced pipe joint connected to the recycled exhaust gas return line. The pipe joint is provided with a radial annular nozzle, or with several lateral nozzles beneath the flue gas hood ceiling.

The flue gas hood ceiling may be equipped with sensors for measuring temperature, and quantity of the furnace gases as well as ceiling temperature, so that the exhaust gas quantity to be returned to the furnace chamber may be regulated through appropriate regulators connected to the sensors depending upon prevailing furnace operating conditions. Finally, a control instrument for the gas quantity flow is installed in the exhaust gas return line, and such instrument is complete with signal. This signal is activated as soon as the flow does not meet a predetermined value.

DETAILED DESCRIPTION OF THE INVENTION

Figure 1:
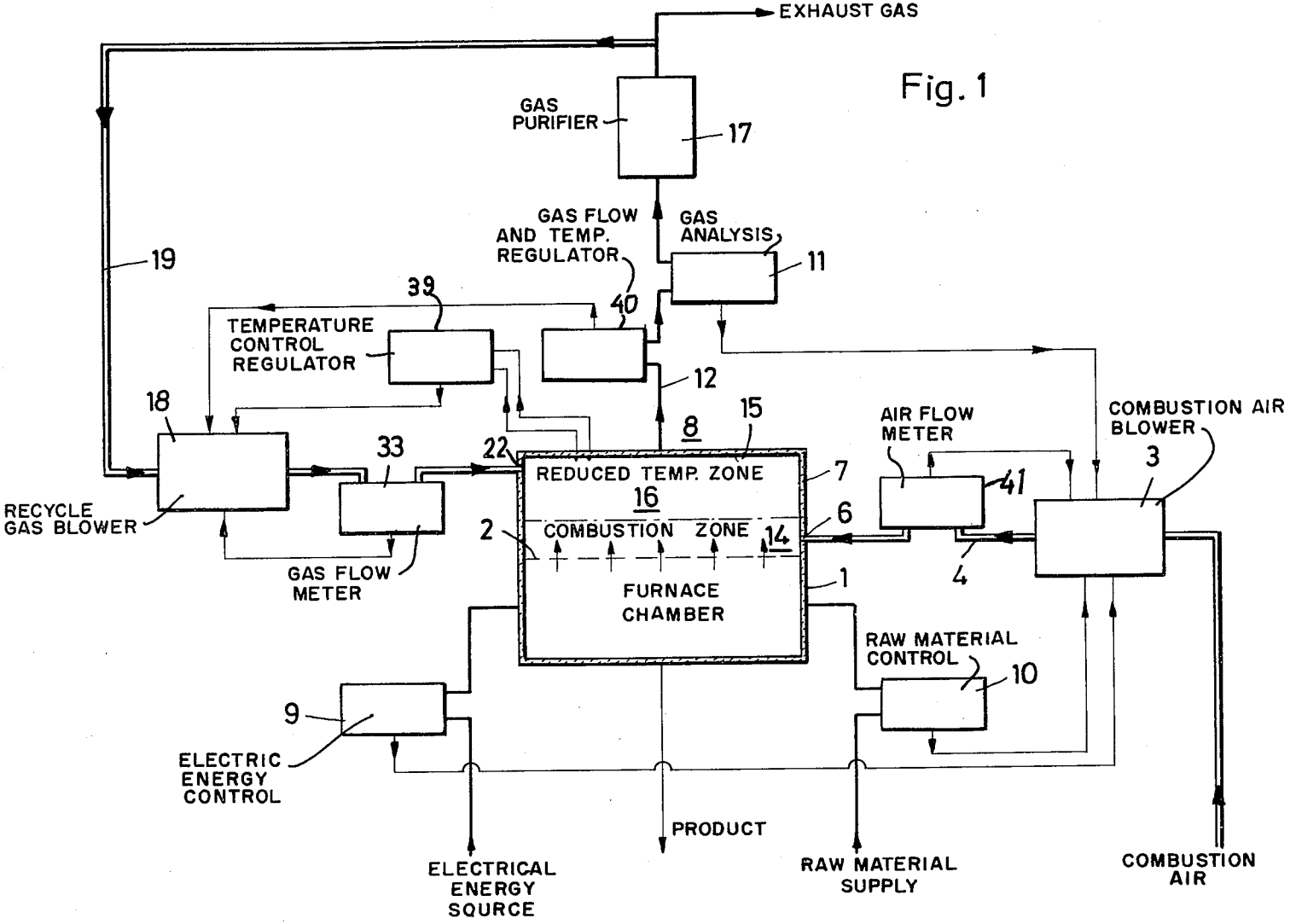
FIG. 1 is a schematic flow diagram illustrating an arrangement of apparatus embodying and for practicing the invention.
Figure 2:
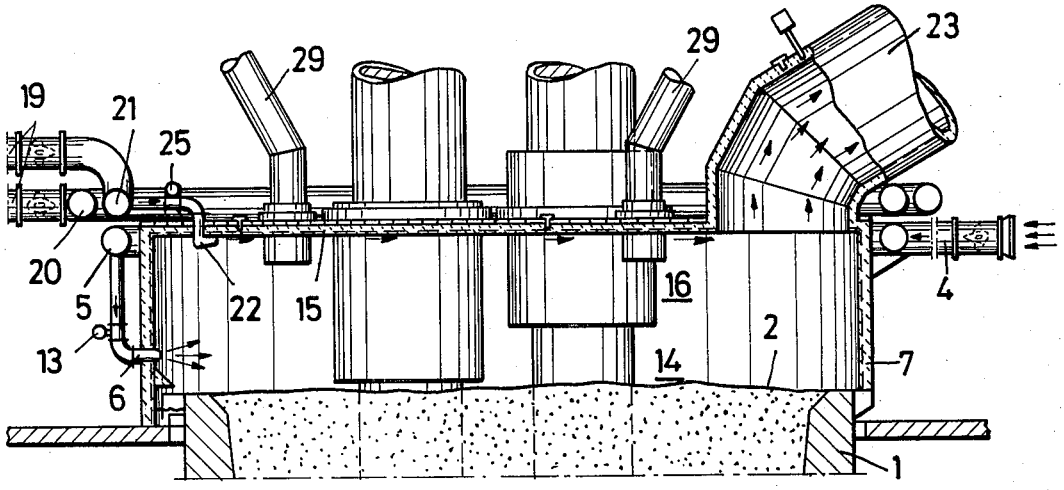
FIG. 2 is a vertical cross section taken along lines I-I of FIG. 3.

Referring to the drawings in which like numbers refer to like parts throughout the several views thereof, FIG. 1 shows combustion air fed into an electrode reduction furnace 1 above its burden surface 2 by means of a blower 3 via air supply line 4, annular line 5 (FIG. 2), and air nozzles 6, which are distributed over shell 7 circumferentially of flue gas hood 8. The quantity of combustion air supplied to nozzles 6 is determined by measuring instruments 9, 10 and 11, which measure electric energy and raw materials supplied to the furnace, as well as analyze conditions in exhaust duct 12. These data regulate the controllable motor of blower 3. To make sure that all air nozzles 6 are at all times supplied with the required quantity of combustion air, flow meters 13 are installed between annular line 5 and each air nozzle 6 (FIG. 3), as well as main flow meter 41 in line 4.

Figure 3:
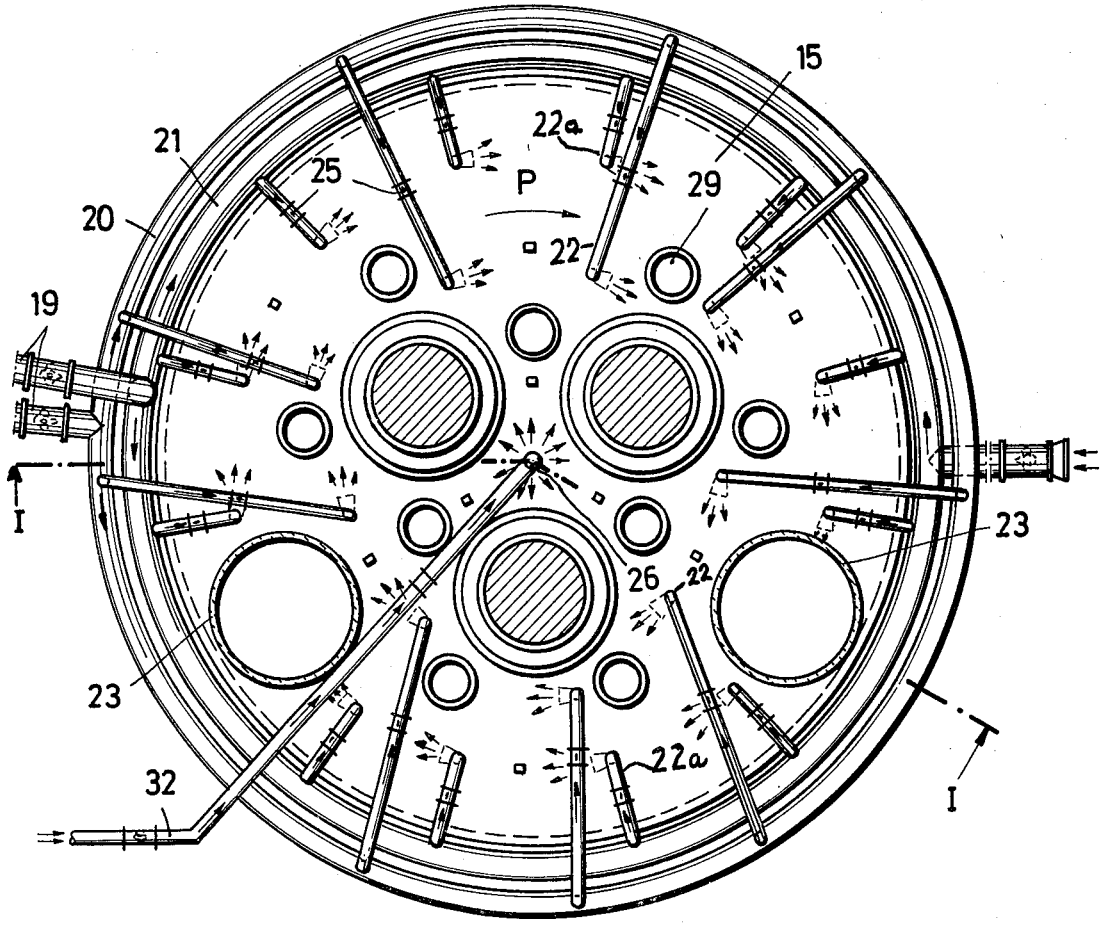
FIG. 3 is a plan view of a flue gas hood illustrating aspects of the invention.

The reduction gas produced burns at very high temperatures within zone 14 located directly above burden surface 2. In order to work with a relatively low construction of flue gas hood 8, and to safeguard its ceiling 15 as well as its integral construction parts from the influence of these high combustion temperatures, cold purified exhaust gas is injected into zone 16 directly beneath flue gas hood ceiling 15. The exhaust gas is returned by means of blower 18 via return lines 19 and two annular lines 20, 21, after treatment in gas purifier and filter 17, and injected directly under hood ceiling 15 by means of wide-angled nozzles **22, 22*a*. For this purpose nozzles 22, 22*a* are positioned horizontally in such a fashion that a flat annular cooling flow is achieved over the entire ceiling 15 in one direction, as shown by the arrow P (FIG. 3), which intensively cools ceiling 15 and which leaves, together with the spent furnace gas, via two lines 23. A flow meter 25 is installed between each broad nozzle 22, 22*a* and their respective annular lines 20, 21. Preferably, nozzles 22, 22*a* are arranged on concentric circles, as shown in FIG. 3 in order to disperse evenly the recycled exhaust gas over ceiling 15**.

Figure 4:
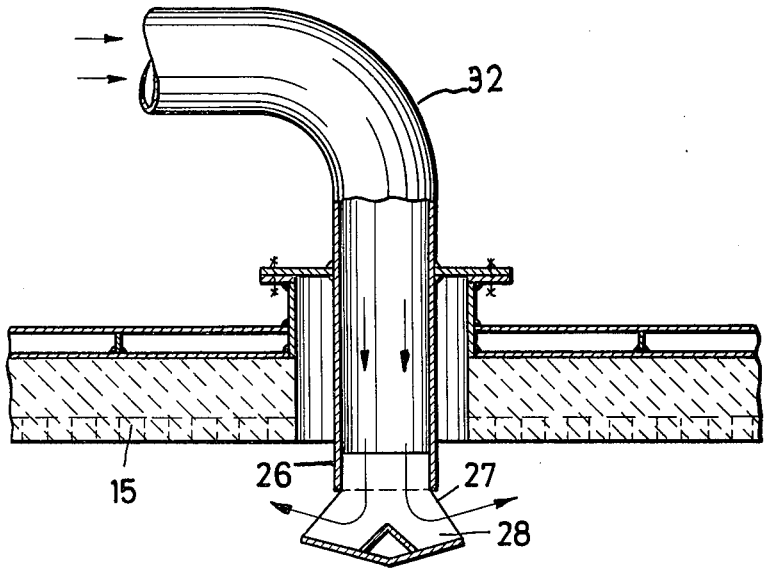
FIG. 4 is a section of the central area of the flue gas hood ceiling with a central cooling gas nozzle.

The center of the hood ceiling 15 is provided with a cooling gas nozzle 26 (FIGS. 3 and 4), which has two semicircular lateral nozzles 27. These nozzles 27, separated only by bracket 28, complement one another to form a radial annular nozzle mouth through which the cooling gas flows radially in all directions to cover the central area of hood ceiling 15. This central arrangement of a cooling gas nozzle 26 avoids lack of cooling in the center of hood ceiling 15 which is particularly susceptible to exposure to hot combustion gases.

Figure 5:
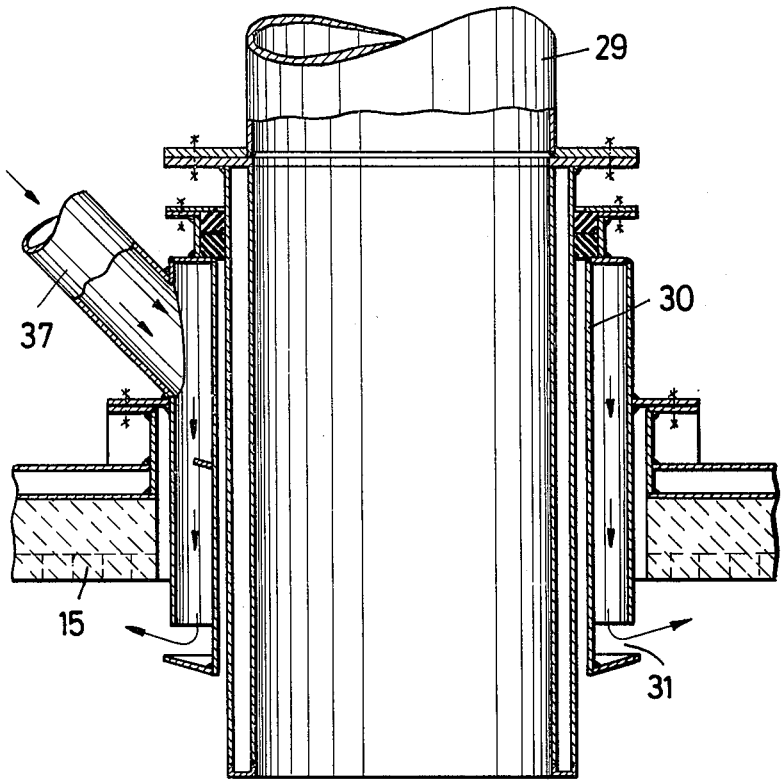
FIG. 5 is a section of the central area flue gas hood ceiling showing a further embodiment with a central burden charge pipe.

Alternatively, this central area of hood ceiling 15 is already provided with a burden charge pipe 29 (see FIG. 5). Annular pipe joint 30, in lieu of central cooling gas nozzle 26, is connected directly to the exhaust gas return line 19 or to one of the two annular lines 20, 21, or to a separate exhaust gas return line 37. Pipe joint 30 encloses burden charge pipe 29 and is spaced therefrom. It is equipped with annular nozzle 31 beneath hood ceiling 15.

Blower 18 for the cooling gas is automatically controlled through regulators 39, 40 and meter 33, depending upon hood ceiling temperature, furnace gas quantity and temperature, as well as cooling gas flow. Instrument 33, which controls the cooling gas flow is equipped, as will be understood by practitioners in the art, with a signal which is activated by failure to reach a predetermined measuring value.

Thus, as will be apparent from the foregoing, there are provided, in accordance herewith, methods and apparatus for operating a closed electric arc reduction furnace in which the quantity of non-utilized combustion air drawn into the furnace is reduced to a minimum. This, in turn, reduces the size of purifying and filtering facilities required to clean the flue gases. This is achieved by positively controlling the introduction of combustion air, both with respect to the area in which it is introduced, and also with respect to quantity. By concentrating introduction of combustion air to a specific zone, the area of hotest combustion gases is deliberately concentrated in spaced fashion from the hood ceiling. Moreover, the hood ceiling is shielded by a cooling zone developed by the concentrated introduction thereover of the recycled, cooled and purified exhaust gases from the furnace itself. This gas may be used because of the low oxygen content of those gases brought about by the actual control of the combustion air intake of the furnace. Because of the protection offered by this concentrated cooling zone adjacent and over the hood ceiling, the ceiling may be much lower and less costly in construction, allowing for servicing of the furnace through the hood. The concentrated introduction of exhaust gases thereover eliminates dirt accumulation, thus reducing to a minimum the need for cleaning the ceiling.

While the methods and forms of apparatus herein described constitute preferred embodiments of the invention, it is to be understood that the invention is not limited to these precise methods and forms of apparatus, and that changes may be made therein without departing from the scope of the invention, which is defined in the appended claims.

We claim:

1. A method for controlled flue gas combustion in a closed arc reduction furnace and having a closed combustion zone with an exhaust gas exit, a source of combustion air, a source of inert or low oxygen containing cooled gas and flow communication means between said zone and said sources of air and gas, characterized by the steps of a. controllably introducing combustion air from said source radially into said zone immediately above the surface of a burden to be reduced;

b. measuring the gases in said exhaust gas exit for controlling the flow of air in said flow communication means between said air source and said zone;

c. controllably introducing in a second introducing step cooled inert or low oxygen containing gas from said source into said zone above the area of introduction of said combustion air; and d. said second introducing step being carried out by introducing said gas in a strong flat flow over the entire upper surface of said zone.

2. The method of claim 1, further characterized by a. said source of cooled gas is exhaust gas filtered and recycled from said exhaust gas exit.

3. The method of claim 2, further characterized by a. said second introducing step being carried out by measuring the temperature adjacent the upper surface of said zone and the gases in said exhaust gas exit for controlling the flow of gas in said flow communication means between said gas source and said zone.

4. The method of claim 1, further characterized by a. said air introduction step being carried out by introducing said combustion air at spaced points circumferentially of said zone.

5. The method of claim 1, further characterized by a. said gas introduction step being carried out by introducing said gas at spaced points circumferentially of said zone.

6. Apparatus for controlled flue gas combustion in a closed arc reduction furnace, and having a closed furnace chamber covered by a hood with an exhaust gas flow, a source of combustion air, a source of cooled inert or low oxygen containing gas, and flow communication means between said gas and air sources and said chamber, characterized by a. a plurality of wide angled air jet nozzles connected to said air flow communication means and spaced apart circumferentially around said chamber wall at a point spaced from the floor and ceiling thereof, said point being adjacent the upper surface of materials to be reduced therein;

b. a plurality of wide angled gas jet nozzles connected to said gas flow communication means and spaced apart circumferentially around said chamber wall immediately adjacent the ceiling thereof;

c. means in said air flow communication means for controlling the quantity of combustion air supplied to said air jet nozzles; and d. means in said gas flow communication means for controlling the quantity of gas supplied to said gas jet nozzles.

7. The apparatus of claim 6, further characterized by a. exhaust gas purifying means in said exhaust gas exit; and b. in which said source of cooled gas is gas from said gas purifying means.

8. The apparatus of claim 7, further characterized by said gas flow control means in said gas flow communication means includes a. blower means for forcibly introducing said recycled cooled gas into said chamber; and b. regulator means connected between said blower means and said chamber and said flue gas exit for controlling the operation of said blower means.

9. The apparatus of claim 6, further characterized by a. said plurality of wide angled gas jet nozzles are in concentric circles with said chamber axis.

10. The apparatus of claim 9, further characterized by a. the orifices of said plurality of jet nozzles are arranged to provide a circular flat cooling flow in one direction around said chamber, said flat cooling flow being parallel to said chamber ceiling.

11. The apparatus of claim 10, further characterized by a. said exhaust gas flue including a plurality of exhaust openings in said ceiling, said openings having a diameter equal to about the radius of said ceiling.

12. The apparatus of claim 6, further characterized by said combustion air flow control means in said air flow communication means includes a. second blower means for forcibly introducing said combustion air into said chamber; and b. second regulator means connected between said second blower means and said flue gas exit for controlling the operation of said second blower means.

13. The apparatus of claim 12, further characterized by a. said second regulator means including connections to the raw material supply and the energy supply to said chamber.

14. The apparatus of claim 6, further characterized by a. an additional gas jet nozzle connected to said gas flow communication means, said additional gas jet nozzle being positioned adjacent said chamber axis along the ceiling thereof; and b. said additional gas jet nozzle having an annular orifice for projecting a flat cooling gas flow across the center of said ceiling.

15. The apparatus of claim 14, further characterized by a. at least one burden charge pipe in said ceiling adjacent the axis of said chamber; and b. said additional gas jet nozzle being supported by said burden charge pipe.

* * * * *